US008647008B2

(12) United States Patent
Bowers et al.

(10) Patent No.: US 8,647,008 B2
(45) Date of Patent: Feb. 11, 2014

(54) SPINE LABEL POCKET FOR A BINDER COVER

(75) Inventors: Andrew Christian Bowers, Hurst, TX (US); John William Pigg, Jr., Cleburne, TX (US); James Robert Schultz, Jr., Fort Worth, TX (US)

(73) Assignee: Samsill Corporation, Fort Worth, TX (US)

( * ) Notice: Subject to any disclaimer, the term of this patent is extended or adjusted under 35 U.S.C. 154(b) by 8 days.

(21) Appl. No.: 13/249,946

(22) Filed: Sep. 30, 2011

(65) Prior Publication Data

US 2012/0080876 A1 Apr. 5, 2012

Related U.S. Application Data

(60) Provisional application No. 61/388,312, filed on Sep. 30, 2010.

(51) Int. Cl.
*B42D 1/00* (2006.01)
*B42D 5/00* (2006.01)

(52) U.S. Cl.
USPC ..... 402/73; 281/3.1; 281/15.1; 402/74; 402/75; 402/76; 402/77

(58) Field of Classification Search
USPC ..... 281/3.1, 15.1, 45; 402/73, 74, 75, 76, 402/77
See application file for complete search history.

(56) References Cited

U.S. PATENT DOCUMENTS

| | | | | |
|---|---|---|---|---|
| 3,809,485 | A | 5/1974 | Beyer | |
| 4,998,840 | A | 3/1991 | Ruble | |
| 5,330,279 | A | 7/1994 | Ruble | |
| 5,711,627 | A | 1/1998 | Chapman | |
| 5,720,564 | A | 2/1998 | Winzen | |
| 5,951,189 | A | 9/1999 | Winzen | |
| 6,019,540 | A | 2/2000 | Senior | |
| 6,109,812 | A | 8/2000 | Welch | |
| 6,267,412 | B1 | 7/2001 | Henderson | |
| 6,290,421 | B1 | 9/2001 | Welch | |
| 6,305,714 | B1 * | 10/2001 | Rossetto et al. | 402/73 |
| 6,761,498 | B1 | 7/2004 | Harris, Jr. et al. | |
| 6,902,340 | B2 | 6/2005 | Harris, Jr. et al. | |
| 2004/0197131 | A1 * | 10/2004 | Harris et al. | 402/73 |

* cited by examiner

*Primary Examiner* — Dana Ross
*Assistant Examiner* — Justin V Lewis
(74) *Attorney, Agent, or Firm* — Whitaker Chalk Swindle & Schwartz PLLC; Stephen S. Mosher

(57) ABSTRACT

A binding cover having a transparent overlay cover disposed over and around the spine of the binding is configured to provide a label pocket on the spine portion of the binding cover wherein a label may be inserted easily without tools or rigid label material. In several embodiments the label pocket provides a fixed label space. In another embodiment the label pocket opens along the spine when the binding cover is opened, and returns to a closed position when closed, thereby retaining a label inserted therein. In another embodiment a method for forming the label pocket is provided.

7 Claims, 8 Drawing Sheets

SPINE LABEL POCKET FOR A BINDER COVER

1. CROSS-REFERENCE TO RELATED APPLICATION

The present application claims priority from Provisional Application Ser. No. 61/388,312, filed Sep. 30, 2010, entitled "Label Pocket for Binder Spine," by the same inventors.

BACKGROUND OF THE INVENTION

2. Field of the Invention

The present invention generally relates to document binders and book bindings and labeling features thereof, and more particularly providing label pockets in binding covers configured for ease of use.

3. Description of the Prior Art

Binding covers for bound materials and documents are available for many applications in a variety of styles and construction. Among such applications are binding covers for binding and storing documents and the like in reusable binders. Many such binders, such as the ubiquitous ring binder include a construction feature for inserting a label in a pocket provided on the cover or spine of the binder cover. The pocket is typically provided by bonding the edges of a transparent plastic layer to the surface of the binder cover or spine along an edge or seam, leaving an upper edge of the transparent layer unbonded and open to allow inserting a label into the pocket. However, such binder covers heretofore have the disadvantage in that, because of the type of construction that provides a pocket having close-fitting panels, it is typically very difficult to insert or remove a label from the pocket easily and without bending or other damage to the label or to the pocket. Two of the reasons for this disadvantage are that there is insufficient space allowed between the transparent layer and the surface of the binder cover, and friction that exists between the facing inside surfaces of the pocket that enhances the difficulty of inserting or removing a label. In the case of thermoplastic materials used for covering the cover boards and providing the transparent overlay, static electricity may present a further impediment to insertion of a label into the pocket.

In one specific example, ring binders are widely used and come in a variety of types (reference, storage, view), sizes (to accommodate thicknesses of 0.5" to 6") and utilize different cover materials (polyvinylchloride or "PVC," polypropylene or "PP," paper, cloth fabric, etc.). The most popular binders on the market are called view or insertable binders. They have a clear overlay over the opaque material allowing for the insertion of printed material in the front, back and spine for customization. The biggest problem since the invention of the view/insertable binder has been getting the label into the spine/hub section of the binder in a timely fashion without damaging the insert or the binder.

A number of attempts exist in the prior art to solve this problem. For example, U.S. Pat. No. 5,711,627 issued to Chapman discloses a "Flexible Spine Binder With Window Pocket and Spine Stiffener Insert," which provides a stiff insert that is required to stiffen the spine of the binder having a flexible spine. The stiffener may also be used as a label. Thus, the stiffener is required both to stiffen the spine and to provide a label that, being of a rigid material enables easier insertion or removal from the pocket. Even if a spine label is not needed as both a tool and a label, the stiffener is required to provide sufficient structural form for the binder. U.S. Pat. No. 5,720,564 issued to Winzen discloses a "Binder With Label Holder" that attaches a transparent sheet attached to a binder cover along seams spaced well away from the vicinity of the hinges connecting the front and rear covers to the spine, thus enabling a conventional size sheet of paper to be inserted and wrapped around the spine within the holder. One disadvantage of this configuration is that the size of paper required is far larger than needed for a label, leading to waste. Another disadvantage is that if the label is made smaller it is likely to fall out or shift position when the binder cover is opened because the clear layer is then allowed to be displaced well away from the binder cover boards.

U.S. Pat. Nos. 6,761,498 and 6,902,340 issued to Harris, Jr., et al. teaches forming the spine board of a binder cover with a depressed area within its borders—i.e., the spine thickness is reduced in the central area of the spine—to provide space for the thickness of a label. This configuration adds manufacturing cost to provide the spine board having a central region thinner than its borders. U.S. Pat. No. 6,267,412 issued to Henderson discloses a "Window Pocket Insertion and Removal Device," which is a tool with special features to enable inserting and removing a spine label from the spine pocket of a conventional binder. The requirement for a tool to insert and remove a spine label is superfluous if such a tool becomes unnecessary in an improved design that enables label installation and removal without a tool.

None of the foregoing examples provide a binder cover having a label pocket design that effectively permits easy insertion or removal of a label without the use of tools and which minimizes the possibility of damage to the label pocket or the label during insertion or removal.

SUMMARY OF THE INVENTION

Accordingly a binding cover for a book is provided comprising a hinged cover board having front and back panels each joined respectively via a first or second hinge to a spine panel disposed between corresponding edges of said front and back panels, and a transparent overlay disposed over respective outer surfaces of the spine panel and the front and back panels and attached to each the front and back panel along first and second seams, each the first and second seam disposed in the vicinity of the hinges and a predetermined spacing from and parallel to a proximate the respective hinge joining a the front or back panel to the spine panel, thereby forming a label pocket between the transparent overlay and the spine panel.

In another aspect the first and second seams are disposed a first predetermined spacing from and on the near side of the first and second hinges from the label pocket and the overlay between the first and second seams is spaced a second predetermined spacing from the spine panel.

In another aspect the first and second seams are disposed a first predetermined spacing from and on the opposite side of the first and second hinges from the label pocket such that the overlay is disposed against the spine panel when the binding cover is closed, wherein the overlay opens to form the label pocket and receive a label when either of the front and back panels of the binding cover are opened.

In another aspect the first and second seams are disposed coincident with the first and second hinges respectively in combination with the overlay between the first and second seams spaced a predetermined spacing away from the spine panel.

In another embodiment a method is disclosed for providing a label pocket on the spine of a book cover having front and back cover panels hinged along first and second hinges to a spine panel, comprising the steps of: placing a transparent overlay sheet around an outer surface of the spine panel and extending the overlay to outer surfaces of the front and back panels to at least a position spaced beyond the hinges from the spine panel; inserting a spacer between the outer surface of the spine panel and an inner surface of the overlay, the spacer being narrower than a width of the spine panel; attaching the overlay to the respective front and back cover panels or to the spine panel, adjacent the hinges along a seam parallel with the hinges; and removing the spacer from between the spine and the overlay following the attaching step.

DETAILED DESCRIPTION OF THE INVENTION

Figure 1:
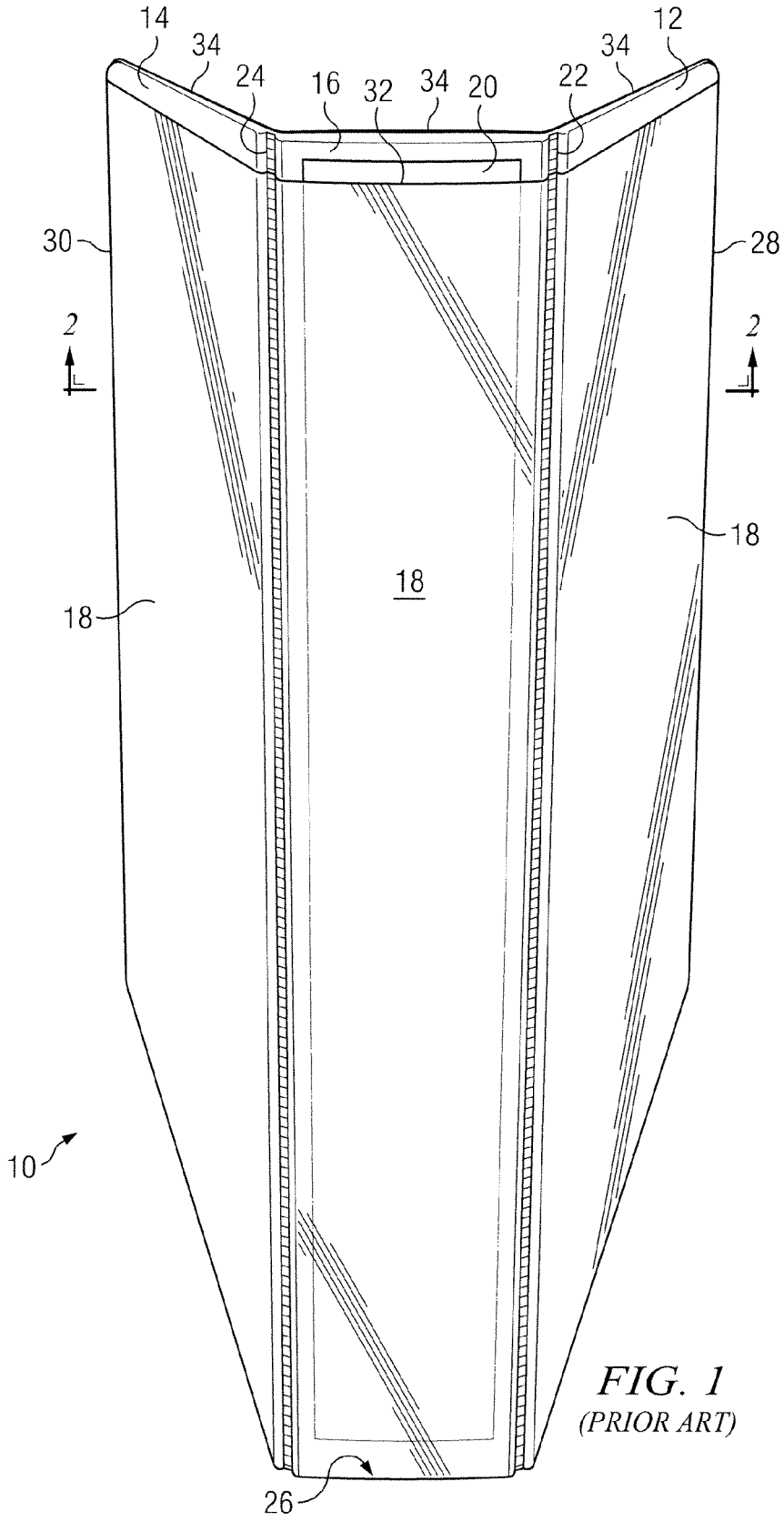
FIG. 1 (PRIOR ART)
FIG. 1 illustrates a prior art binder cover having a clear overlay secured against the spine panel at the cover hinges to provide a spine label pocket.

The invention in its several embodiments is described with reference to the following figures illustrating essential features of the invention to provide a binder cover apparatus—and a method for fabricating it—that is equipped with a spine label pocket configured for repeated easy insertion and removal of a spine label without damage to the label or the spine label pocket space, and without the use of tools or other aids. In a preferred embodiment the spine label pocket is pre-formed in a transparent overlay attached to the binder cover so that it has a defined space provided for the label whether the binder cover is closed or opened. In another embodiment (seals disposed in the vicinity of and inside the hinges) the spine label pocket is also pre-formed but has an additional pair of seals along the label pocket in the vicinity of the hinges to better define the pocket and permit the use of certain materials for the clear overlay. In yet another embodiment (seals disposed in the vicinity of and outside the hinges) the clear overlay is attached just outside but in the vicinity of the hinges. In this embodiment the spine label may be inserted or removed by opening the binder cover sufficiently to cause the label pocket to bulge outward, thus opening the pocket to expand the space within the pocket, wherein the label may be easily inserted or removed. Closing the binder cover draws the transparent layer of the spine against the label and the spine of the binder cover to secure the label within the pocket. Removal is simply the reverse of these steps: open the binder cover to open the pocket and pull the label insert from the pocket. A fourth embodiment includes a method of fabricating a binder cover to provide the preferred embodiment. The method is readily adaptable to all described embodiments because of the structural similarities among them. Persons skilled in the art will realize that all illustrated embodiments and other equivalents may be fabricated using variations of the same method as described herein.

In an example of a use of the present invention, ring binders may be provided having a transparent plastic cover sheet overlaid and bonded to the binder cover along the side and bottom edges leaving the upper edge at the margin open. This configuration creates a pocket for inserting a title sheet for the front cover or a title label for inserting in a spine pocket along the spine or hub of the binder. The spine pocket provides for quick customization of the binder cover by allowing easy insertion of labels in the spine pocket between the transparent and opaque plastic cover materials. Distinctive features of the present invention are provided by revisions to the methods of manufacturing that provide a spine label insert pocket for a binding cover with substantially improved usability and freedom from damage to the label or the binder cover. The invention may be readily adapted to other binding cover applications such as book or document covers and the like, including without limitation a loose-leaf binder, a ring binder, a document binder, a case-bound book, a case-bound document, a hard back book, a book cover, a scrapbook, an album, a photo album, and a bound portfolio.

Further details of the invention are included in the following description with reference to the drawings and the appended claims to the invention. In the figures to be described, structures identified with the same reference numbers in more than one drawing are understood to refer to the same structural feature. While the embodiments of the present invention to be described contain some of the same component parts or features, the invention will be understood to reside in the complete combination of features illustrated and described for each exemplary embodiment in the following detailed description.

FIG. 1 illustrates a prior art binder cover having a clear overlay secured against the spine panel at the cover hinges to provide a spine label pocket. While a pocket is provided by the illustrated cover, it is difficult to use because of the lack of sufficient space for the label to be easily inserted or removed. The friction, or in some cases the static electricity that typically exists between the inside facing surfaces of the pocket often enhances the difficulty, resulting in damage to the pocket or the label or both in attempts to insert or remove the label. In the figure, the binder cover 10 includes a front cover 12, a back cover 14, and a spine or spine panel 16 joined to the respective front and back covers along hinges 22 and 24. Hinge 22 joins the front cover (or panel) 12 to the spine 16. Hinge 24 joins the back cover (or panel) 14 to the spine 16. The front and back covers 12, 14 and spine 16 may be clad on at least their outer surfaces in a plastic material such as polyvinylchloride ("PVC"), polypropylene ("PP"), fabric, or paper, for example. Wrapped around and against the outer surfaces of the front 12 and back 14 covers and the spine 16 is a layer or sheet—overlay 18—of clear plastic material such as PVC or PP. The overlay 18 may be secured to the front and back covers 12, 14 and spine 16 along the lower 26 and outer side 28, 30 edges of the respective panels. The upper edge 32 of the overlay 18 is typically unsecured and positioned somewhat away from (below in the view of FIG. 1) the upper edges 34 of the front 12 and back 14 covers and spine 16. Also depicted inserted into the label space between the spine 16 and the overlay 18 is a label 20, a portion of which is exposed above the upper edge 32 of the overlay 18, shown without indicia. Note that the space between the upper edge 32 of the overlay 32 and the upper edges 34 of the front and back covers and spine 16 may be called the margin of the binder cover in this description.

Figure 2:
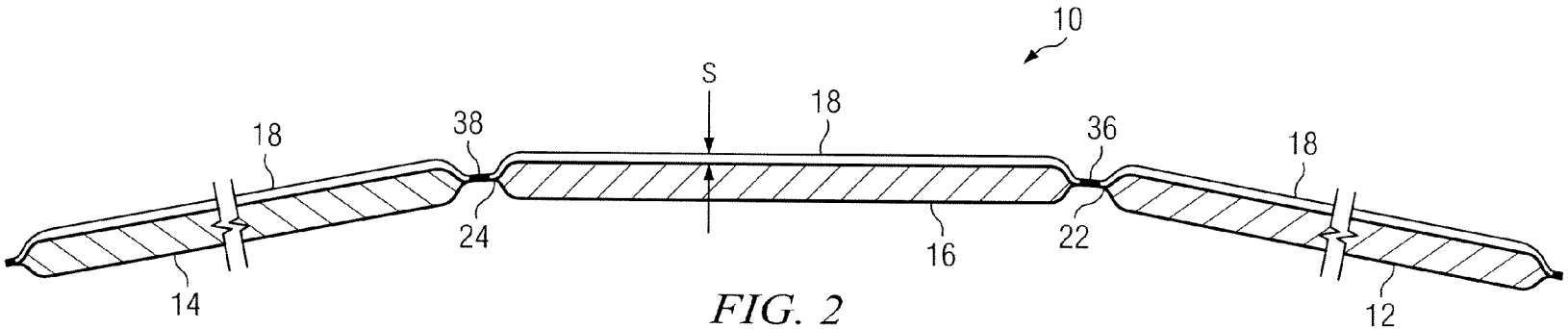
FIG. 2 (PRIOR ART)
FIG. 2 illustrates a cross section or end view of the prior art binder cover of FIG. 1 showing the clear overlay disposed close to the spine of the binding cover.

FIG. 2 illustrates a cross section or end view of the prior art binder cover 10 of FIG. 1 shown in a wide open disposition and looking upward in the view shown in FIG. 1 toward the top edge of the cover 10. The front 12 and back 14 covers and the spine panel 16 are clad with the clear overlay 18 on the outer surfaces thereof. The clear overlay 18 is additionally secured to the first hinges 22, 24 joining the front 12 and back 14 covers to the spine panel 16 by a seal 36, 38 disposed respectively along the length of the hinges 22, 24. The seals 36, 38 are indicated by the rectangular dots at the locations of the hinges 22, 24. It will be noted that FIG. 2 shows the clear overlay 18 disposed close to the spine 16 of the binder cover 10 as indicated by the dimension "s" (40). The dimension "s" may vary from zero millimeters through typically some fraction of a millimeter up to approximately one millimeter. In general, little or no space is provided in this prior art example because the overlay 18 is disposed snugly against the spine 16, making it difficult to insert a label 20 of any thickness because of the tight clearance, the effects of friction and static electricity, etc. It is especially difficult to feed a thin, full-length label into this minimal space, without undue stress on the hinge seals or damage to the label 20.

Figure 3:
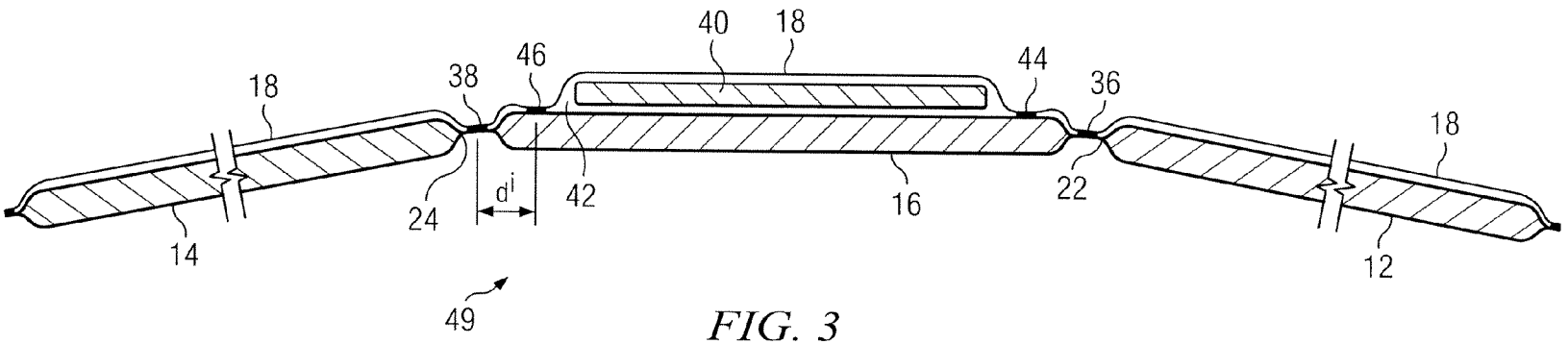
FIG. 3 illustrates an end view of a first embodiment of a binder cover according to the present invention, to provide a fixed spine label pocket.

FIG. 3 illustrates an end view of a first embodiment of a binder cover according to the present invention, that provides a spine label pocket to overcome the problems noted herein above. The view in FIG. 3 depicts a cross section of the cover assembly 49 during fabrication wherein a spacer insert 40 having a predetermined thickness is placed against the spine 16 of the cover assembly 49. The spacer insert 40 used for forming the defined label space of each of the embodiments described herein may have a thickness in millimeters of 0.2 mm to 2.0 mm in typical applications, but may vary beyond this range of values in certain specific applications. During fabrication, when the overlay material 18 is placed upon the outer surfaces of the cover assembly 49 formed by the front 12, back 14 and spine 16 panels joined at first 22 and second 24 hinges, first and second bonding steps providing a sealing or welding of the materials take place to secure the overlay material 18 to the cover assembly 49 at the locations shown. In one of the sealing steps a bond—a seal or weld or seam—may be applied in a variety of methods well-known in the art to the combination of the cover assembly 49 and the overlay material 18 at each of the locations of the first and second hinges 22, 24 to create first and second compound seals 36, 38 respectively. In the other of the bonding or sealing steps, a second seal, weld, or seam is applied to the combination of the cover assembly 49 and the overlay material at each of the locations indicated in FIG. 3 by the third and fourth seals 44, 46 respectively. The third 44 and fourth 46 seals capture the spacer 40 between them, forming a defined label space 42. It will be understood by persons skilled in the art that the sealing methods may include but not be limited to application of heat, pressure, adhesives, stitching and other processes suitable for the manufacturing required.

Figure 4:
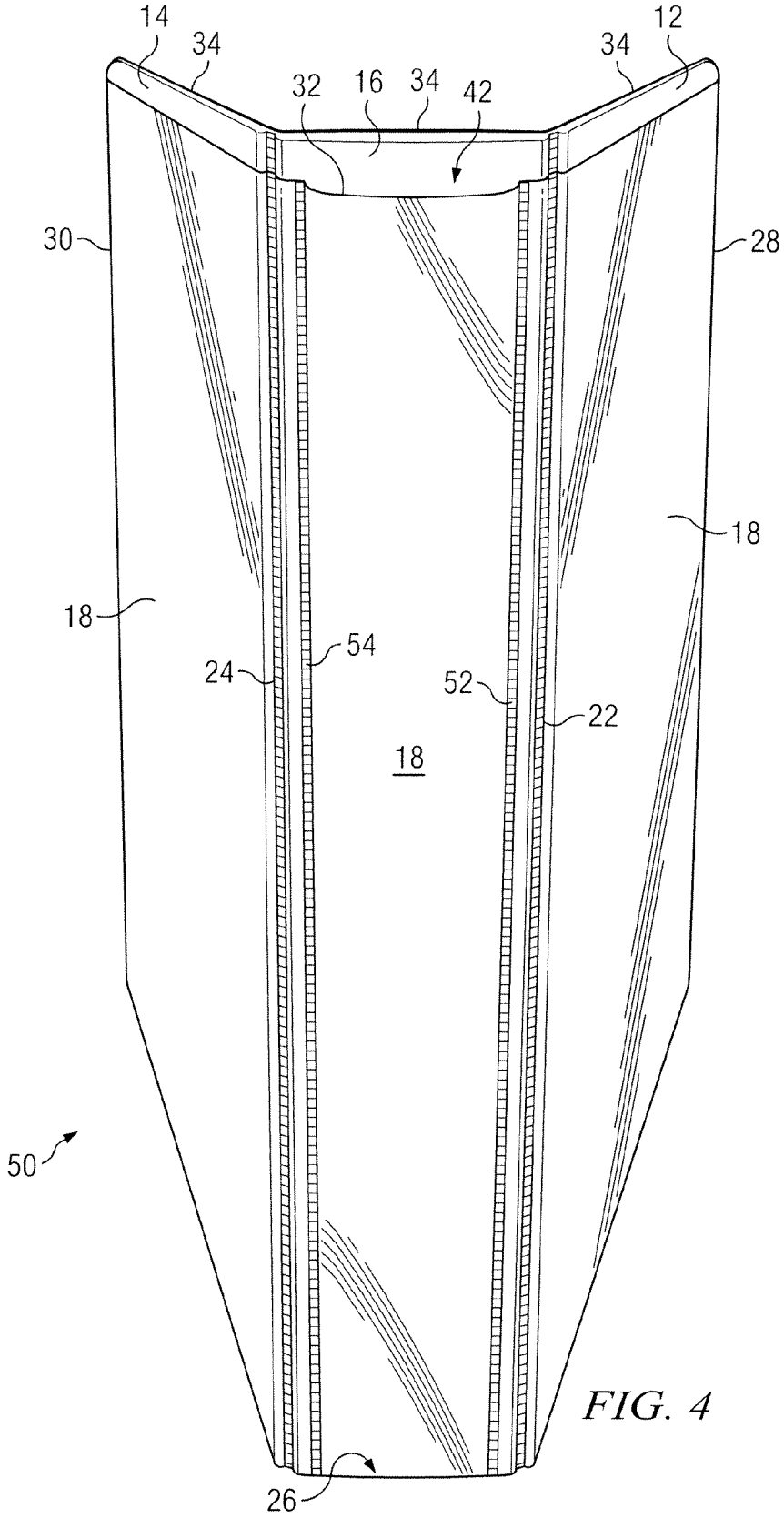
FIG. 4 illustrates a binder cover having a clear overlay according to the first embodiment of the present invention illustrated in FIG. 3.

Near the end of the fabrication process, after the sealing steps are completed, the spacer 40 may be removed, producing a finished binder cover 50 having a "built-in" label space 42 formed along the spine 16, as shown in FIG. 4 to be described. Alternatively, the spacer 40 may also be left in place during shipment and removed before the binder cover 50 is placed in use. It should be noted that the third 44 and fourth 46 seals are disposed in the vicinity of the hinges 22, 24 but spaced by a predetermined distance $d^i$ (for the distance between the inside of the region between the first and second hinges 22, 24 and the proximate respective edge of the spacer 40). This predetermined distance $d^i$ may be preferably in the range of 1.0 to 5.0 mm, but may vary depending on the particular type or application of the binder cover 50. In use, the spacer 40 may be moved to permit insertion of the spine label as desired. Use of the binder cover 50 and flexing of it to open or close it will not distort or otherwise affect the spine label pocket 42. The space created during fabrication is thus preserved for use, allowing insertion and removal of a label 20, even ones made of relatively soft, non-rigid materials, with tools or risk of damage to the label itself.

FIG. 4 illustrates a binder cover 50 having a clear overlay according to the first embodiment according to the present invention illustrated in FIG. 3, shown with the spacer insert 40 removed and depicted in an upright perspective view looking toward the spine of the binder cover 50. The front 12 and back 14 cover panels or boards are joined to the spine panel 16 along the first 22 and second 24 hinges respectively to form the basic binder cover. A transparent overlay 18 is shown attached to the binder cover 50 along the bottom edge 26 and the first 28 and second edges 30. The transparent overlay 18 extends toward the top edge 34 of the cover panels 12, 14, and 16 such that the upper-most edge 32 of the transparent overlay 18 is disposed at a point a few millimeters below the edge 34 along the upper margin (the space between the edges 32 and 34). The upper edge 32 of the overlay 18 is not attached to the cover panels 12, 14 or to the spine panel 16 in the margin to allow paper inserts to be inserted between the surface of the cover panels 12, 14, 16 and the transparent overlay 18. As described in FIG. 3, the binder cover 50 is fabricated to form a defined label space 42 to enable insertion of a label (not shown, but see FIG. 1 for an example of a label 20 shown in dashed lines) without impediment and without requiring the use of any kind of tool to facilitate inserting the label 20 in the defined label space 42. Also as described in FIG. 3, the label space 42 is given definition by the third 52 and fourth 54 seals, welds, or seams disposed between the hinges 22, 24 and the edges of the spacer insert 40 before it was removed, thus forming the binder cover 50 as shown.

FIG. 5 illustrates in a sequence of views A through F a process for producing the spine label pocket of the first embodiment of FIGS. 3 and 4. In this embodiment a piece of spacing material and additional seals will be shown as they may be used during the manufacturing process. The view in FIG. 5A shows a sheet of opaque cover material 60 cut to size and spread over the cover panels 12, 14 and spine panel 16. The opaque cover material may be made of polyvinyl chloride or polypropylene sheet material having a thickness suitable for the application. The positions of the adjacent edges of the cover panels 12, 14 and spine panel 16 underneath the opaque cover material 60 are shown in dashed lines in FIG. 5A, but not shown in FIGS. 5B through 5F for clarity of the process. In FIG. 5A the edges of the cover panels 12, 14 and the spine panel 16 that coincide with the edges of the opaque cover material (top, bottom, and left and right sides in the figure) are also not shown to preserve the clarity of the process being described. In FIG. 5B, a spacer 40 is placed over the opaque cover material 60 directly over and centered between the positions where the hinges 22, 24 will be formed with respect to the spine panel 16. The spacer 40 may be approximately the same length as the spine panel 16 and have a thickness that may vary between 0.020 and 0.125 inch (or, 0.5 to 3.0 mm). The spacer 40 (or alternately, spacer insert 40) may be formed from a variety of materials including paper, plastic, wood, or a composite of these or other suitable materials. The spacer insert 40 may be shaped and dimensioned to suit particular applications. For example, some binder covers may not be substantially flat as shown in the embodiments illustrated herein, but may have a round convex or concave profile requiring a different configuration of spacer insert 40 to provide a suitable spine label pocket. Further, while the spacer 40 is normally removed following completion of the manufacturing process, it may be retained in the spine pocket 42 (FIGS. 3, 4, and 5F), 62 (FIGS. 6 and 7), or 72 (FIGS. 8 and 9) as packaged for shipment and removed by the end user when the binder cover is placed into service.

Figure 5A:
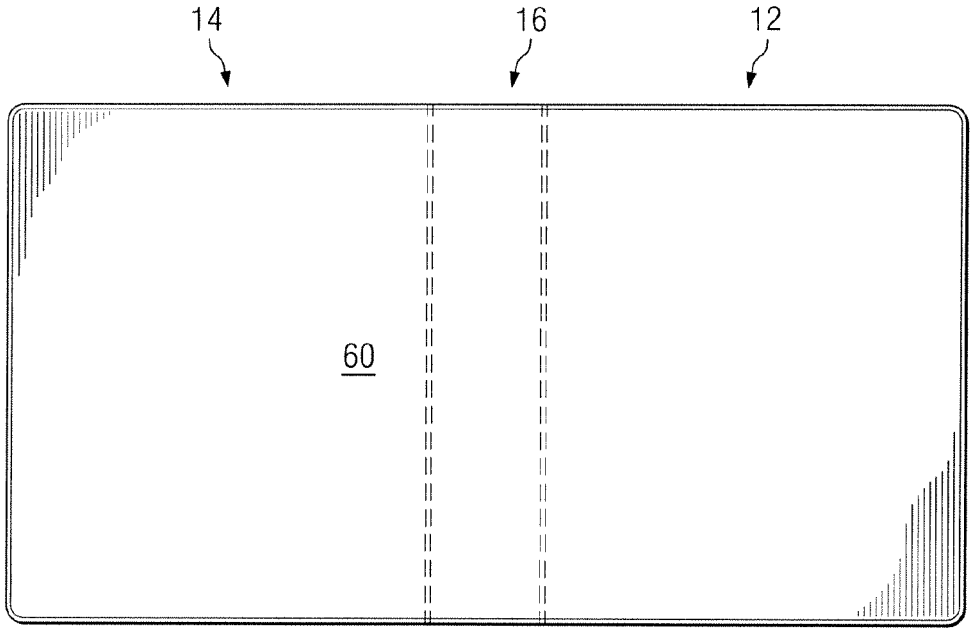
FIG. 5 illustrates in a sequence of views A through F a process for producing the spine label pocket of the first embodiment of FIGS. 3 and 4.
Figure 5B:
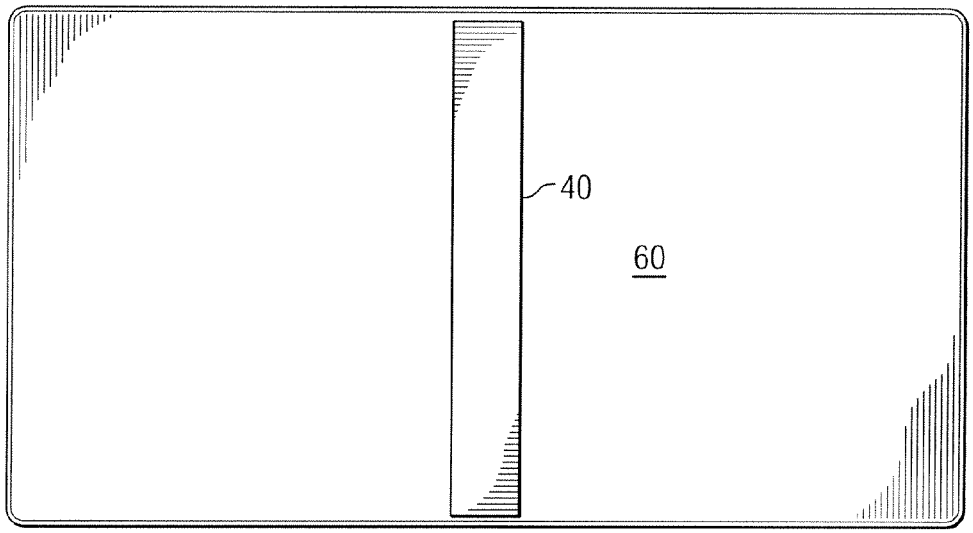
Figure 5C:
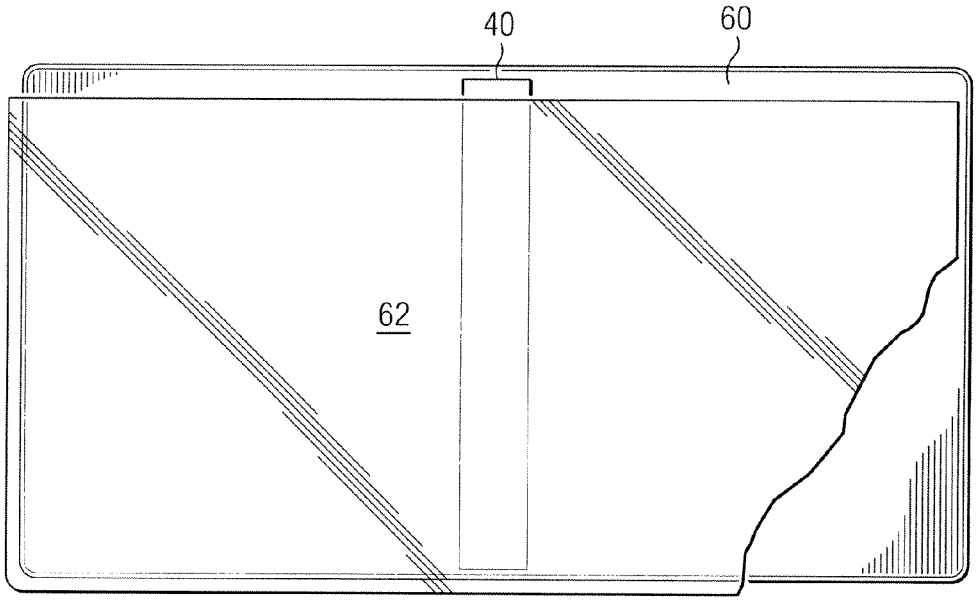
Figure 5D:
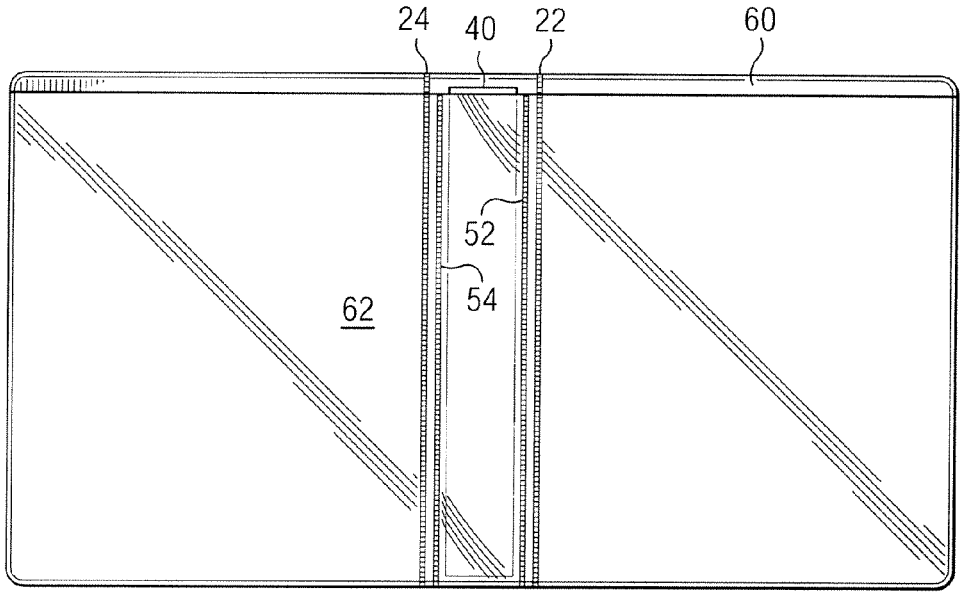
Figure 5E:
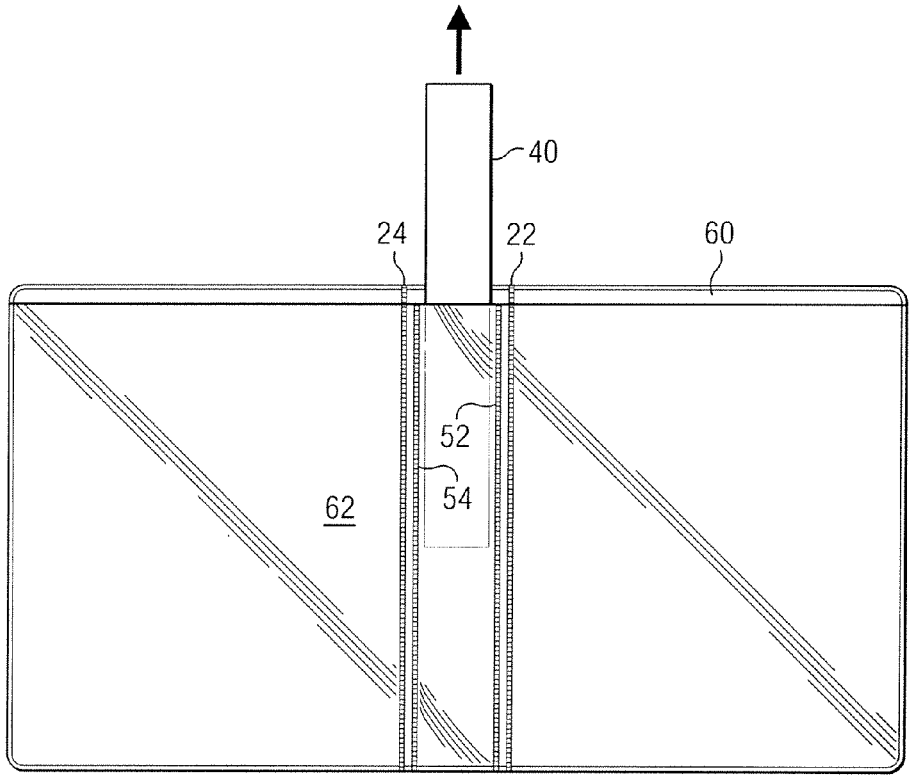
Figure 5F:
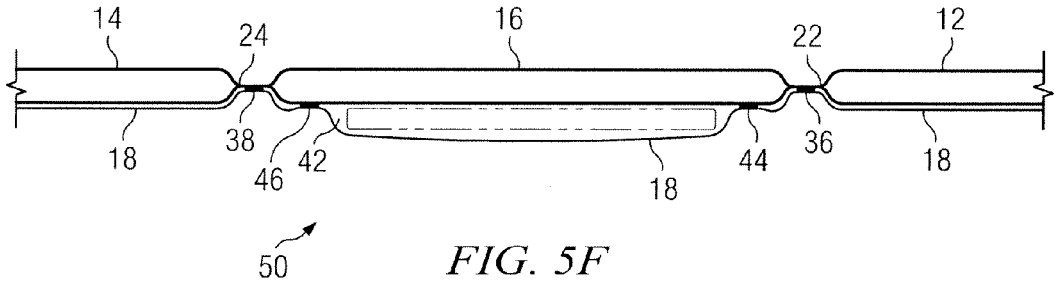

Continuing with FIG. 5C, a layer of transparent plastic 62 having a thickness in the range from 0.05 mm to approximately 0.30 mm is placed over the assembled spacer insert 40 and opaque cover layer 60. The transparent plastic layer 62 will become the transparent overlay 18 in the finished binder cover. Next, as shown in FIG. 5D both front 12 and back 14 cover panels are bonded or sealed along the outside (right 28 and left 30 edges as shown in FIG. 4) and bottom 26 edges of the front 12 and back 14 cover panels and along the hinge joints 22, 24 between the cover boards and spine panel 16. The process for manufacturing the present invention then adds a step by applying a bar seal, weld, seam, or other bond 52, 54 between the position of the spacer 40 on each side thereof and the proximate (nearby) hinge joint at the locations 22, 24. After all bonding or sealing is complete the spacer 40 is removed as depicted in FIG. 5E to leave a permanent space (label space or spine pocket 42, as shown in FIG. 4) between the transparent overlay 62 and the spine panel 16. This label space 42 also depicted in FIG. 5F, in a view looking downward from a position above the binder cover 50 with both front 12 and back 14 covers opened wide, allows the easy insertion of a label into it. Note that the position of the spacer 40 is indicated by dashed lines in FIG. 5F. This method is superior to other methods on the market because it saves time, prevents damage to the components of the binder cover 50 and doesn't require any additional tools. It also makes for easy removal of a spine label allowing for the ring binder having the binder cover 50 to be reused.

Figure 6:
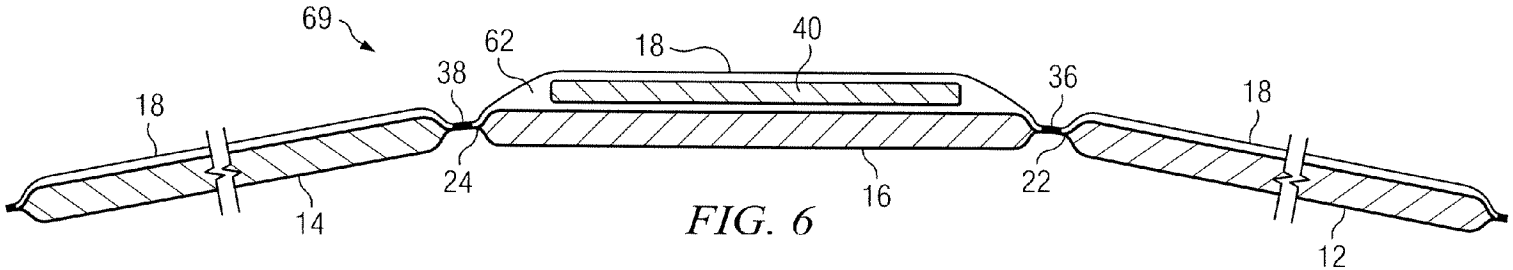
FIG. 6 illustrates an end view of a second embodiment of a binder cover according to the present invention to provide a fixed spine label pocket.
Figure 7:
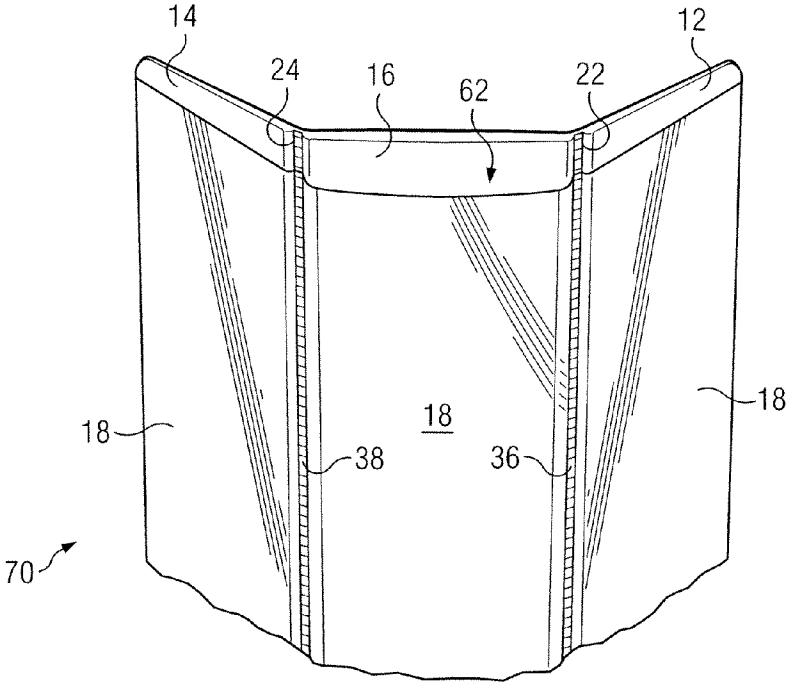
FIG. 7 illustrates a binder cover having a clear overlay according to the second embodiment of the present invention illustrated in FIG. 6.

FIG. 6 illustrates an end view of a second embodiment of a binder cover 69 according to the present invention to provide a fixed spine label pocket 62. The second embodiment is similar to the first embodiment described in FIGS. 3, 4, and 5A through F except that it omits the second pairs of seals, welds, or seams 52, 54 in a fabrication process that employs the steps illustrated in FIGS. 5A, 5B, 5C, and 5E in sequence, resulting in the binder cover 70 depicted in FIG. 7. The perspectives of the binder cover 69 in FIG. 6 and the finished binder cover 70 in FIG. 7 are similar to the perspectives shown in FIGS. 3 and 4 respectively, except that the finished binder cover 70 is illustrated in truncated form with its lower extremity omitted. The second embodiment of FIGS. 6 and 7 provides a label pocket 62 defined by boundaries along or coincident with the hinged joints 22, 24 instead of along the separate seals, welds, or seams 52, 54 as shown in FIGS. 3 and 4. This label pocket 62 provides a little more space for a label and is less expensive to manufacture.

Figure 8:
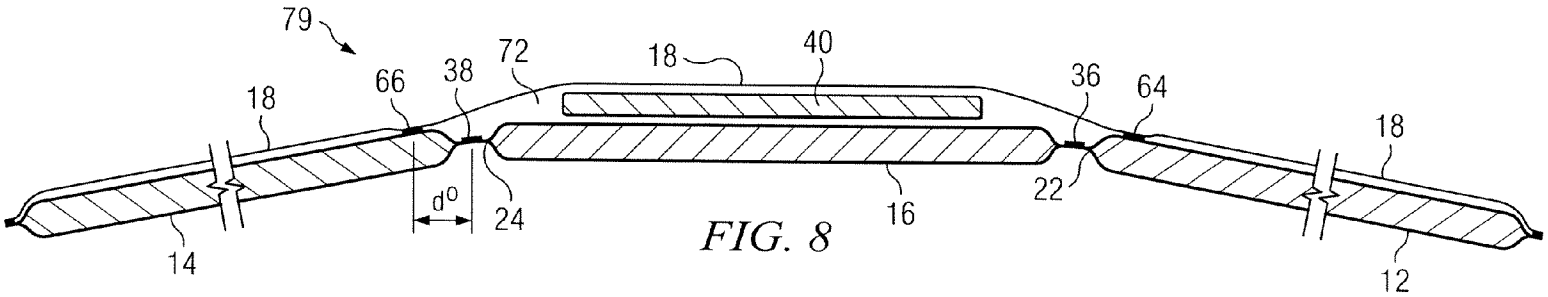
FIG. 8 illustrates an end view of a third embodiment of a binder cover according to the present invention to provide a spine label pocket that opens when the binder cover is opened.

FIG. 8 illustrates an end view of a third embodiment of a binder cover 79 according to the present invention to provide a spine label pocket 72 that opens when the binder cover is opened. In this embodiment another bonding or sealing step is added during the manufacturing process, similar to that illustrated in FIGS. 5A through 5F, but the added bonds or seals are placed in a different location on the binder cover panels 12, 14 from the first embodiment. The first three steps of the fabrication process are the same is depicted in FIGS. 5A, 5B, and 5C. Then, in step 5D, the third embodiment is produced by placing the added seals, fifth seal 74 and sixth seal 76, on the opposite side of the hinges 22, 24 from the spine panel 16, i.e., outside the hinges 22, 24 but still in the vicinity thereof. It should be noted that the fifth 74 and sixth 76 seals are spaced by a predetermined distance $d^o$, the distance toward the outside of the region from the first and second hinges 22, 24). This predetermined distance $d^o$ may be preferably in the range of 1.0 to 5.0 mm, but may vary depending on the particular type or application of the binder cover 50.

Figure 9:
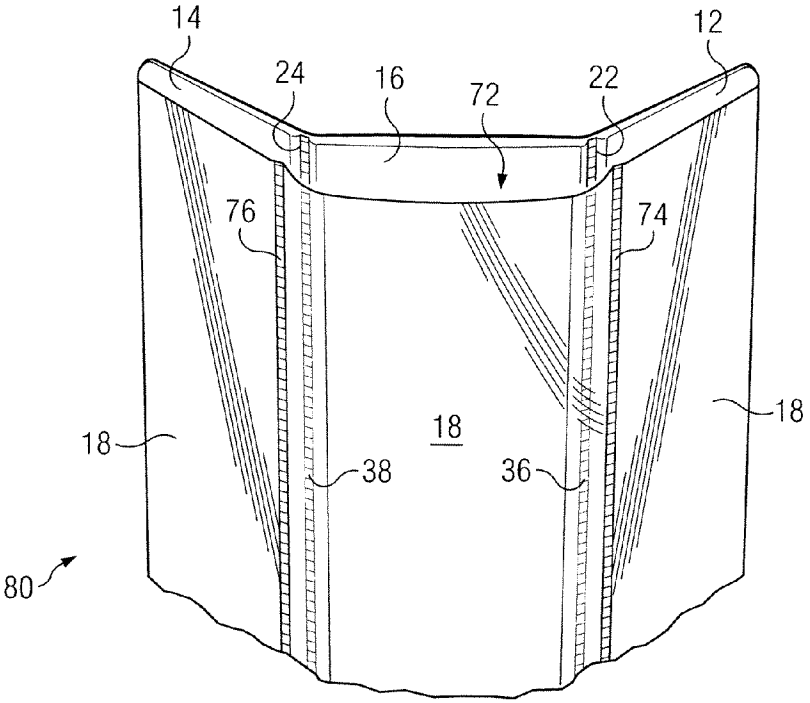
FIG. 9 illustrates a binder cover having a clear overlay according to the third embodiment of the present invention illustrated in FIG. 8.

This places the bonds between the transparent overlay 18 and the binder covers 12, 14—i.e., seals, welds, or seams 74, 76 on the surface of the front 12 and back 14 cover panels respectively. Next, when the seals 74, 76 are in place, the spacer 40 may be removed, as in Step 5E, leaving the finished binder cover 80 as shown in FIG. 9 with the spine label pocket 72. These extra seals 74, 76 disposed in the range of 1.0 to approximately 5.0 mm outside of the traditional binder hinge joint but still in the vicinity thereof provide additional width in the spine region between the transparent and opaque material when the binder cover 80 is opened. Additionally, when the binder cover 80 is closed, each of the second pair of seals 74, 76 move with the front and back cover panels 12, 14, i.e., they separate, and the extra space within the spine label pocket 72 is drawn against the surface of the spine 16, causing the transparent 18 and opaque layers to approach each other. This embodiment, in which the features of the first and second embodiment described herein are combined, thus provides more space for a label insert. Further, it will be appreciated that this third embodiment of the binder cover 80, which provides the spine label pocket 72, is formed differently and operates differently in use.

The embodiments described herein adapt the binder covers to improved function and save time, prevent damage to insert labels, and do not require additional tools to insert or remove labels. The illustrated embodiments provide for easy removal of the label allowing for the binder to be easily reused or its title changed. While the invention has been shown in only several of its forms, it is not thus limited but is susceptible to various changes and modifications without departing from the spirit thereof. For example, the binding cover of the present invention is readily adapted to covers for binding other forms of books including without limitation a loose-leaf binder, a ring binder, a document binder, a case-bound book, a case-bound document, a hard back book, a book cover, a scrapbook, an album, a photo album, and a bound portfolio. The invention applies to the cover boards or panels of the covers of the book or binder and the spine board or panel attached between them along hinged joints, and the particular configuration of the clear overlay—in three illustrated embodiments—in the region of the spine for inserting a label.

What is claimed is:

1. A method for providing a label pocket on the spine of a book cover having front and back cover panels hinged along, first and second hinges to a spine panel, comprising the steps of:

placing a transparent overlay sheet around an outer surface of said spine panel and extending said overlay to outer surfaces of said front and back panels to at least a position spaced beyond said hinges from said spine panel;

inserting a spacer between said outer surface of said spine panel and an inner surface of said overlay, said spacer being narrower than a width of said spine panel;

attaching said overlay to said respective front and back cover panels or to said spine panel, adjacent said hinges along a seam parallel with said hinges;

applying an additional seal between said spacer and a proximate first or second hinge to secure said transparent overlay to said vine at a location along and adjacent to each longer side of said spacer; and then removing said spacer from between said spine and said overlay following said attaching step.

2. The method of claim 1, further comprising the step of:

providing a spacer having a thickness dimension of at least 0.50 mm and less than approximately 3.0 mm.

3. The method of claim 1, further comprising the step of:

forming the spacer from a material selected from the group consisting of paper, plastic, wood, and a composite material.

4. The method of claim 1, comprising the step of:

providing, a thin sheet of transparent polyvinyl chloride (PVC) or polypropylene (PP) having a thickness of at least 0.05 mm, and less than approximately 0.30 mm.

5. The method of claim 1, comprising the step of:

providing for each first and second seam a continuous bond of said transparent overlay to said respective front and back panel and extending, substantially the length of said spine panel.

6. The method of claim 1, comprising the step of providing a binding for an article selected from the group consisting of a loose-leaf binder, a ring binder, a document binder, a case-bound book, a case-hound document, a hard back book, a book cover, a scrapbook, an album, a photo album, and a bound portfolio.

7. The method of claim 1, further comprising the step of:

opening said front and back cover panels of said book cover thereby enabling said label pocket to open to receive a label therein.

* * * * *

UNITED STATES PATENT AND TRADEMARK OFFICE

CERTIFICATE OF CORRECTION

PATENT NO. : 8,647,008 B2
APPLICATION NO. : 13/249946
DATED : February 11, 2014
INVENTOR(S) : Bowers et al.

It is certified that error appears in the above-identified patent and that said Letters Patent is hereby corrected as shown below:

In the Claims:

Col. 9, line 9 should read as follows:

applying an additional seal between said spacer and a proximate first or second image hinge to secure said transparent overlay to said spine ~~vine~~ at a location along and adjacent to each longer side of said spacer; and Signed and Sealed this
Twenty-ninth Day of April, 2014

Michelle K. Lee

Michelle K. Lee
*Deputy Director of the United States Patent and Trademark Office*